US008424481B2

(12) United States Patent
Tsai

(10) Patent No.: US 8,424,481 B2
(45) Date of Patent: Apr. 23, 2013

(54) GLUING MECHANISM INCORPORATING NOTCHED GLUE SCRAPER FOR USE IN WINDING WEB MATERIAL AND METHOD THEREOF

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 817 days.

(21) Appl. No.: 12/458,886

(22) Filed: Jul. 27, 2009

(65) Prior Publication Data

US 2010/0129543 A1 May 27, 2010

(30) Foreign Application Priority Data

Nov. 21, 2008 (TW) ..... 97145130 A

(51) Int. Cl.
*B05C 1/06* (2006.01)
*B05C 1/08* (2006.01)
*B05C 3/02* (2006.01)

(52) U.S. Cl.
USPC ..... 118/261; 118/262; 118/413; 118/414

(58) Field of Classification Search ..... 118/261, 118/262, 413, 414
See application file for complete search history.

(56) References Cited

U.S. PATENT DOCUMENTS 3,552,670 A * 1/1971 Herman ..... 242/527.1
3,991,708 A * 11/1976 Huebschmann et al. ..... 118/258
4,164,911 A * 8/1979 Nicholson ..... 118/670
4,814,204 A * 3/1989 Carey et al. ..... 118/261
5,031,569 A * 7/1991 Eriksson ..... 118/413
5,266,114 A * 11/1993 Iwasaki ..... 118/261
5,628,868 A * 5/1997 Marschke et al. ..... 118/261
6,047,640 A * 4/2000 Murakawa ..... 101/423
6,547,881 B1 * 4/2003 Klockner ..... 118/264
2006/0208127 A1 * 9/2006 Tsai ..... 242/526
2007/0102562 A1 * 5/2007 Tung-I ..... 242/533
2009/0025863 A1 * 1/2009 Tsai ..... 156/184

FOREIGN PATENT DOCUMENTS

TW 346842 12/1998
TW M248523 U 11/2004

OTHER PUBLICATIONS

Communication From Taiwan Patent Office in a Counterpart Foreign Application Dated (Taiwan Year 101) Aug. 22, 2012.

* cited by examiner

*Primary Examiner* — Dah-Wei Yuan
*Assistant Examiner* — Binu Thomas
(74) *Attorney, Agent, or Firm* — Rosenberg, Klein & Lee

(57) ABSTRACT

A gluing mechanism incorporating a notched glue scraper and a method thereof are disclosed. A glue dispensing roller is provided adjacent to a web material traveling path where a web material is conveyed to get past, and operated to touch glue contained in a glue tank, and accordingly, a glue carrying roller surface of the glue dispensing roller is coated with the glue. A notched scraper blade, which faces the glue carrying roller surface of the glue dispensing roller, scrapes the glue stayed on the portion of the glue carrying roller surface, which corresponds with the non-notched area of the scraper edge. Comparatively, the glue stayed on the rest of the glue carrying roller surface is formed a glue layer for subsequently applying to a gluing side of the web material, wherein the rest of the glue carrying roller surface corresponds with notched area of the scraper edge.

3 Claims, 12 Drawing Sheets

GLUING MECHANISM INCORPORATING NOTCHED GLUE SCRAPER FOR USE IN WINDING WEB MATERIAL AND METHOD THEREOF

FIELD OF THE INVENTION

The present invention relates to a gluing mechanism for winding a web material, and in particular to a gluing mechanism that incorporates a notched scraper blade for gluing a winding web material and a method thereof.

BACKGROUND OF THE INVENTION

A conventional paper core used in a web material winding mechanism is conveyed to a location beside a first winding roller by a conveyor and is then forced into a curved guiding passage by a push plate to reach a winding nip. The paper core is wound around by a web material, such as a length of a tissue paper in the winding nip to form a web material roll, such as a tissue paper roll. During the winding process, trans-printing techniques are employed to apply an initial glue or a tail glue to the web material. Alternatively, a rotatable bar is used to touch and carry glue and the glue carried by the rotatable bar is then transferred to a web material.

SUMMARY OF THE INVENTION

However, gluing by trans-printing techniques suffers insufficiency and irregularity of gluing. On the other hand, the rotatable bar is often rotated at a high speed and the glue attached may be easily thrown away due to the action of centrifugal force. Such thrown glue would be difficultly collected and recycled.

Thus, an objective of the present invention is to provide a gluing mechanism for use in a web material winding device and a method thereof, wherein the web material can be glued sufficiently and regularly under control according to the glue amount and gluing area.

Another objective of the present invention is to provide a gluing mechanism for a web material winding device, which can be used for recycling the excessive glue after gluing.

In accordance with the present invention, a gluing mechanism incorporating a notched scraper blade is provided, comprising a glue dispensing roller, which is provided at a location adjacent to the web material traveling path and faces the gluing side of the web material, the glue dispensing roller being rotatable in a given rotation direction, the glue dispensing roller having a glue carrying roller surface; a glue tank, which is provided beside the glue dispensing roller and contains therein an amount of glue; a notched scraper blade, which extends in a direction substantially parallel with an axial of the glue dispensing roller and faces the glue carrying roller surface of the glue dispensing roller, the notched scraper blade having a scraper edge that is adjacent to and in touch with the glue carrying roller surface of the glue dispensing roller, the scraper edge of the notched scraper blade forming at least one notch; and a glue collection tank, which is provided below the glue dispensing roller by a given distance. The glue tank can be alternatively set below the glue dispensing roller to also function as a glue collector, whereby the glue collection tank can be eliminated.

When the glue dispensing roller is driven to rotate, the glue carrying roller surface of the glue dispensing roller touches and carries the glue from the glue tank. The glue carried by the glue carrying roller surface of the glue dispensing roller, when passing the scraper edge of the notched scraper blade, is subjected to scraping by the scraper edge of the notched scraper blade to have a portion of the glue that is at a location not corresponding to the notch scraped off from the glue carrying roller surface. Another portion of the glue that is at a location corresponding to the notch of the notched scraper blade is allowed to form a glue layer on the glue carrying roller surface of the glue dispensing roller upon passing through the notch of the notched scraper blade for being subsequently applicable to the gluing side of the web material.

In an embodiment of the present invention, at least one pushing member is further included, which is arranged by a contact side of the web material that is opposite to the gluing side. When the pushing member is driven by a driving mechanism to rotate, the web material is pushed by the pushing member to touch the glue layer on the glue carrying roller surface of the glue dispensing roller so as to have the web material coated with the glue.

The technical solution adopted by the present invention is to employ the scraper edge of the notched scraper blade to scrape off portions of the glue that are not at locations corresponding to glue passing zones on the glue carrying roller surface of the glue dispensing roller before the glue is applied to the web material, and only allowing portions of the glue that are at locations corresponding to the glue passing zones to be left on the glue carrying roller surface of the glue dispensing roller, making the glue remaining on the glue carrying roller surface of the glue dispensing roller distributed at desired sites that are determined according to the arrangement of the glue passing zones. The size and shape of the glue passing zones determine the quantity and thickness distribution of the glue left on the glue carrying roller surface of the glue dispensing roller, whereby regulation of the application of glue to the glue dispensing roller can be effectively realized. Besides sufficient and uniform distribution of the glue applied to the glue dispensing roller, manipulating the size and shape of the glue passing zones is also advantageous to realize strengthening or modification of gluing strength to suit the needs of various web materials to be rolled up.

In another embodiment of the present invention, besides controlling the distribution sites of the glue on the glue carrying roller surface of the glue dispensing roller, the notched scraper blade of the present invention is also functioning to remove excessive glue from the glue carrying roller surface of the glue dispensing roller. Further, the location of the glue tank can be alternatively set below the glue dispensing roller whereby the removed excessive glue is allowed to directly flow down back into the glue tank and the additional glue collection tank can be eliminated. In this way, the overall construction is made simple by the elimination of the glue collection tank, and time and labor needed in transferring the glue from the glue collection tank to the glue tank can thus be saved. In addition, since the glue inside the glue tank can be supplemented by the removed excessive glue, the cost of the glue is reduced.

BRIEF DESCRIPTION OF THE DRAWINGS

The present invention will be apparent to those skilled in the art by reading the following description of the best mode for carrying out the present invention, with reference to the attached drawings, in which.

DETAILED DESCRIPTION OF THE PREFERRED EMBODIMENTS

Figure 1:
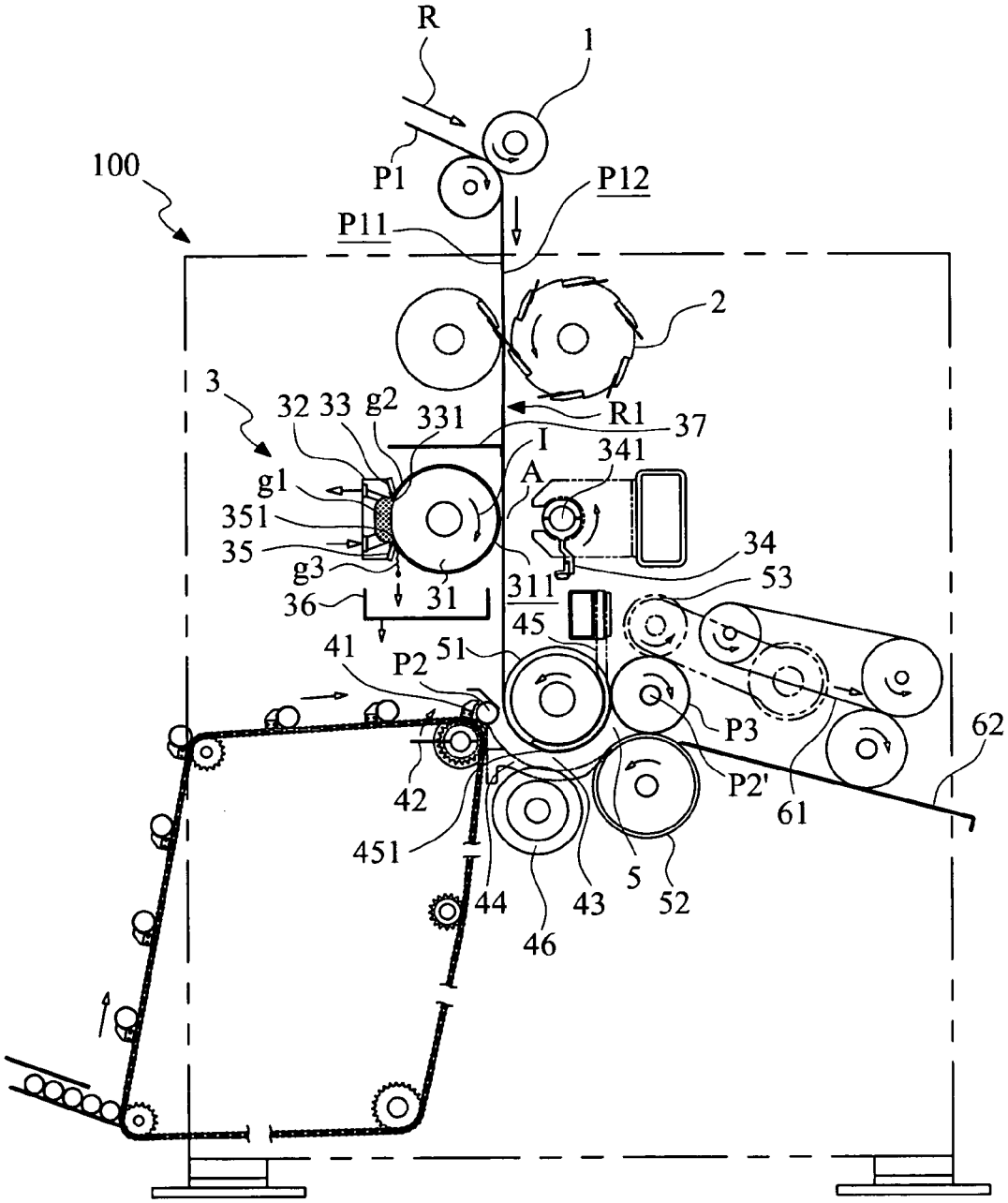
FIG. 1 is a schematic side view of a first embodiment of the present invention.
Figure 2:
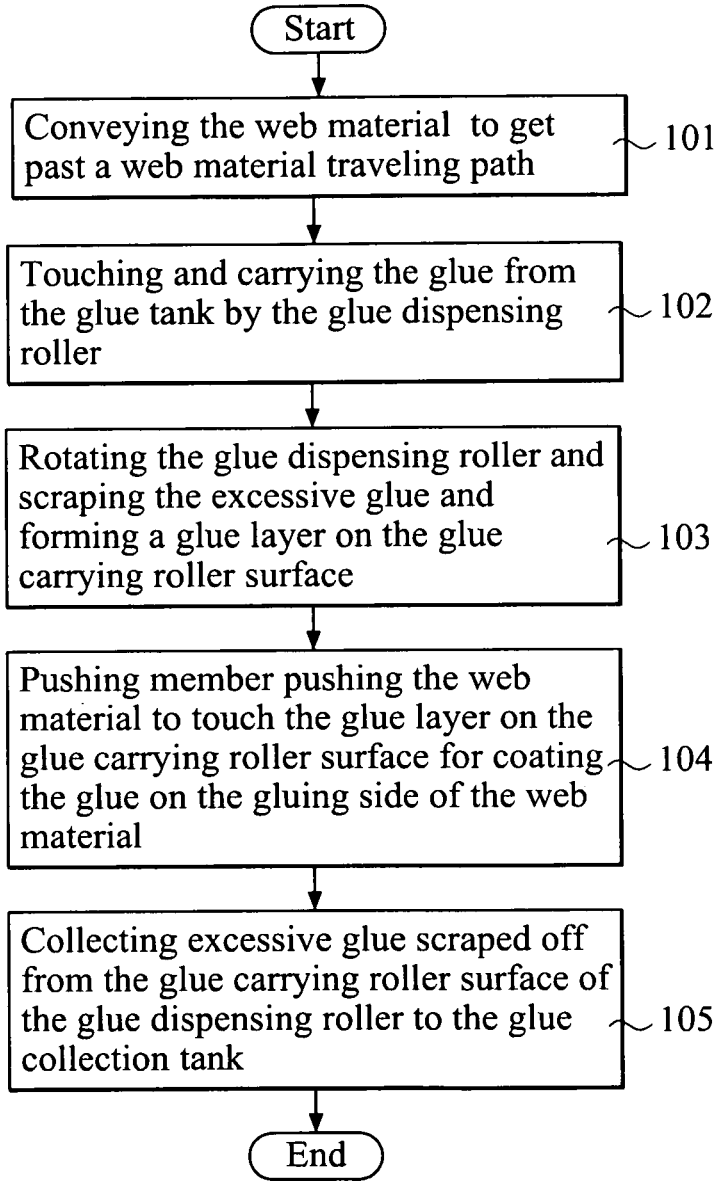
FIG. 2 is a flow chart of the first embodiment of the present invention.
Figure 3:
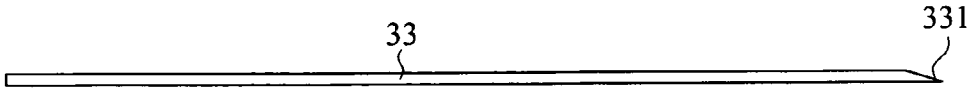
FIGS. 3-6 are side views of various notched scraper blades having different configurations of scraper edge.
Figure 4:
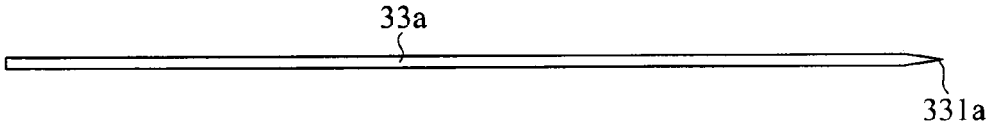
Figure 5:
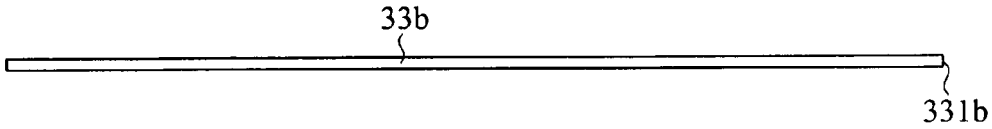
Figure 6:
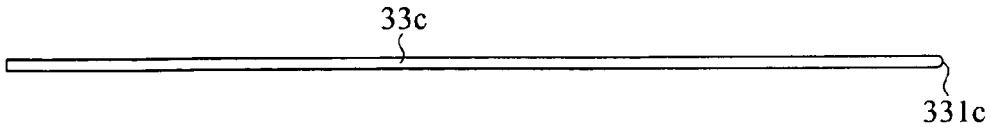

With reference to the drawings and in particular to FIGS. 1 and 2, which respectively illustrate a schematic side view of a web material winding device that includes a gluing mechanism and a flow chart of a method for application of glue in accordance with a first embodiment of the present invention, the web material winding device illustrated in FIG. 1 is broadly designated at 100. The web material winding device 100 is operated in such a way that a web material P1, such as a tissue paper sheet, is first drawn by a pair of feed rollers 1 in a given conveyance direction R into the web material winding device 100 and then passes through a perforation roller 2 that forms a perforated line at every preset distance in the web material P1. Thereafter, the web material P1 is conveyed to get past a web material traveling path R1 (referring to step 101 showed on the FIG. 2) where the gluing mechanism, which is designated with reference numeral 3, carries out localized application of glue on the web material P1.

The gluing mechanism 3 carries out gluing operation by causing glue to coat on a gluing side P11 of the web material P1 when the web material P1 travels through the web material traveling path R1. The gluing mechanism 3 comprises a glue dispensing roller 31, a glue tank 32, a notched scraper blade 33, at least one pushing member 34, a flat scraper blade 35, a glue collection tank 36, and a fender 37.

The glue dispensing roller 31 is provided at a location adjacent to the web material traveling path R1 and facing the gluing side P11 of the web material P1, and is rotatable according to a given rotation direction I. The glue dispensing roller 31 has a glue carrying roller surface 311. The glue tank 32 is provided beside the glue dispensing roller 31 and contains an amount of glue g1.

Figure 7:
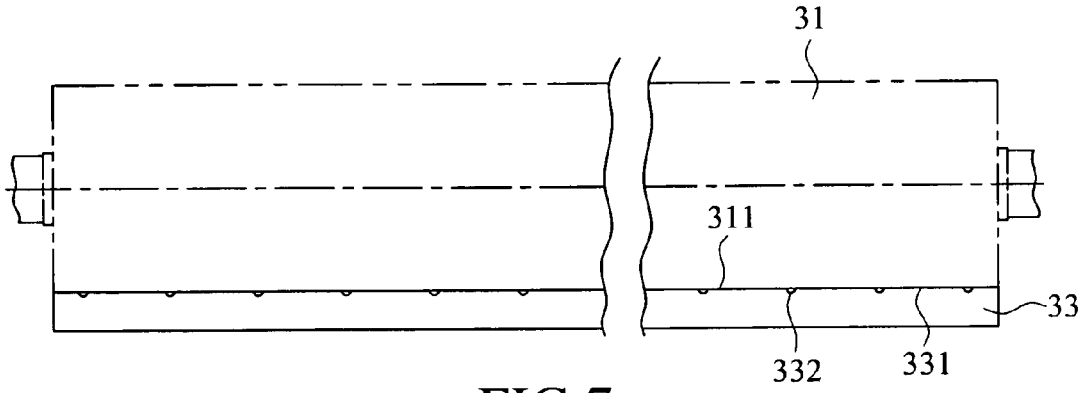
FIG. 7 a schematic top view showing an assembly of one of various notched scraper blades and a glue dispensing roller.

The notched scraper blade 33 is provided in parallel with the axial of the glue dispensing roller 31 and faces the glue carrying roller surface 311 of the glue dispensing roller 31 (referring to FIG. 7 also). The notched scraper blade 33 has a scraper edge 331 that is used to touch the glue carrying roller surface 311 of the glue dispensing roller 31. Referring to FIGS. 3-6, FIGS. 3-6 are side views of various notched scraper blades having different configurations of scraper edge are illustrated. As shown in these drawings, although in the first embodiment of the present invention, the scraper edge 331 of the notched scraper blade 33 has a cross-sectional configuration of single-side tapered awl-shape, it is feasible to make the scraper edge 331 other shapes, such as a double-side tapered awl-shaped scraper edge 331*a* of a notched scraper blade 33*a*, a rectangular scraper edge 331*b* of a notched scraper blade 33*b*, or a rounded scraper edge 331*c* of a notched scraper blade 33*c* ; the scraper edge 331 can be of any desired shape to suit various needs.

Figure 8:
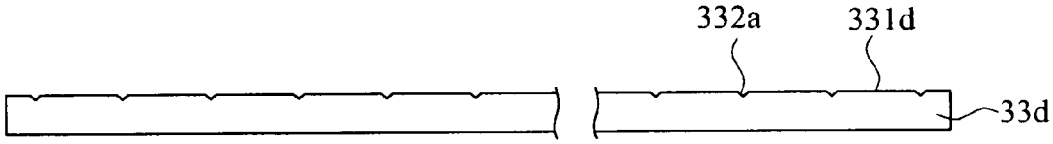
FIGS. 8-10 are schematic top views of various notched scraper blades forming notches of different shapes.
Figure 9:
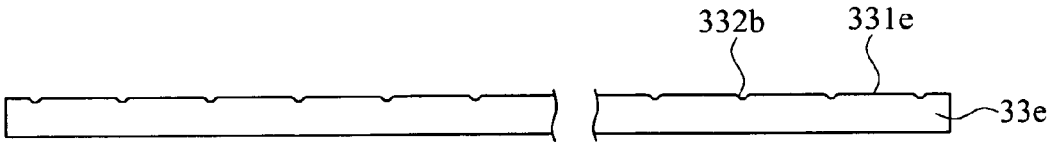
Figure 10:
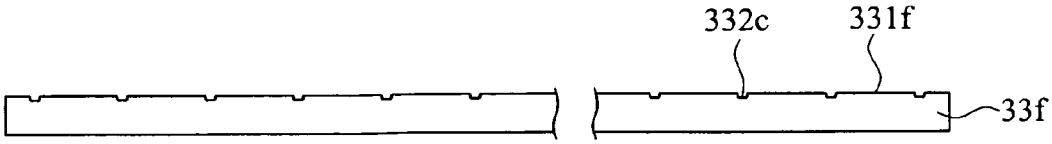

Referring to FIGS. 7-10, FIG. 7 is a schematic top view showing an assembly of one of various notched scraper blades and a glue dispensing roller and FIGS. 8-10 are top plan views of various notched scraper blades forming notches of different shapes are illustrated. The notched scraper blade 33 is with the scraper edge 331, which has at least one notch 332 that is provided on the corresponding determined area of the web material P1 which is glued. In the first embodiment of the present invention, the notch 332 is a recess having a curved shape and forms the notched area, while the area without the notch is the non-notched area. However, it is also feasible to adopt a notched scraper blade 33*d* having a scraper edge 331*d*, wherein the scraper edge 331*d* is with V-shaped notches 332*a*, a notched scraper blade 33*e* having a scraper edge 331*e*, wherein the scraper edge 331*e* is with trapezoidal shape notches 332*b*, or a notched scraper blade 33*f* having a scraper edge 331*f*, wherein the scraper edge 331*f* is with rectangular shape notches 332*c* ; the notches 332 may alternatively be of other shapes. The shape and size of the notches can be properly determined in accordance with the amount of glue to be applied.

Figure 11:
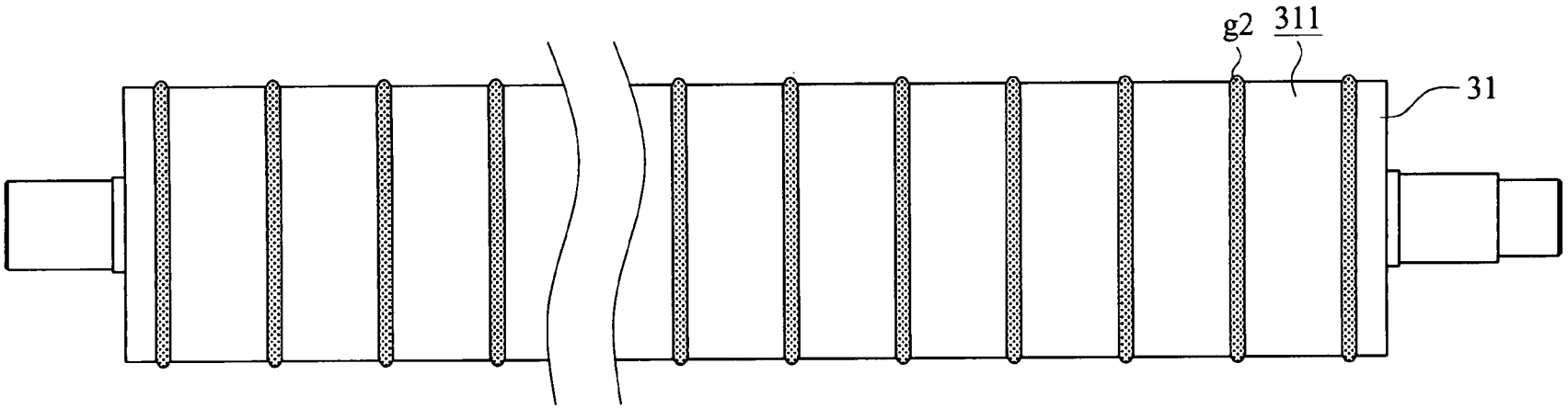
FIG. 11 is a top view of a glue dispensing roller after coating with glue.

Referring to FIG. 11, a top view of the glue dispensing roller after coating with the glue is illustrated. When the glue dispensing roller 31 is in rotation, the glue carrying roller surface 311 of the glue dispensing roller 31 touches the glue g1 contained in the glue tank 32 to have a portion of the glue g1 coated thereto (referring to FIG. 13 and referring to step 102 showed on the FIG. 2 also). The glue g1 coated on the glue carrying roller surface 311 of the glue dispensing roller 31, when passing the scraper edge 331 of the notched scraper blade 33, is subjected to scraping by the scraper edge 331 of the notched scraper blade 33 to have portions of the glue g1 that are at locations not corresponding to the notches 332 scraped off from the glue carrying roller surface 311 (see the FIG. 7 also), but leaving the portions of the glue g1 that are at locations corresponding to the notches 332 of the notched scraper blade 33 to form a pattern or layer of glue g2 on the glue carrying roller surface 311 of the glue dispensing roller 31 (referring to step 103 showed on the FIG. 2).

Figure 12:
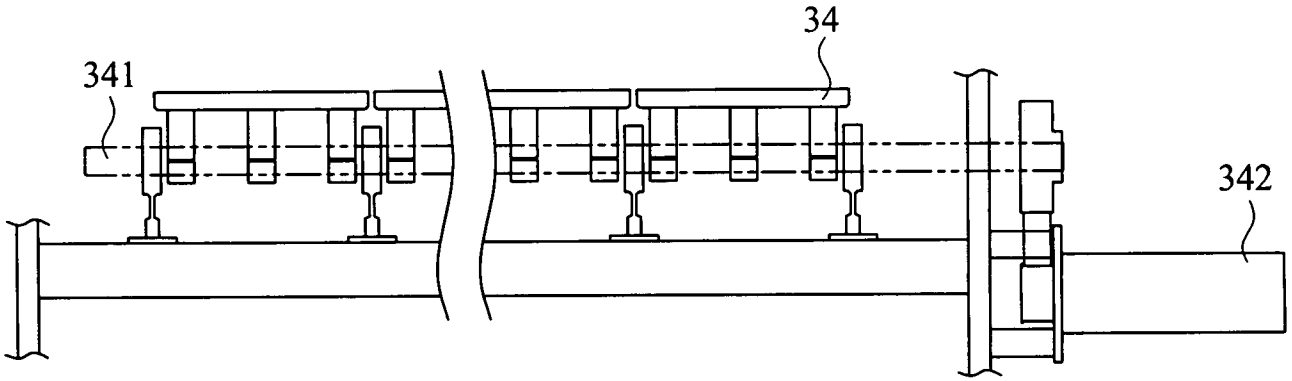
FIG. 12 is a top view of a pushing member.
Figure 13:
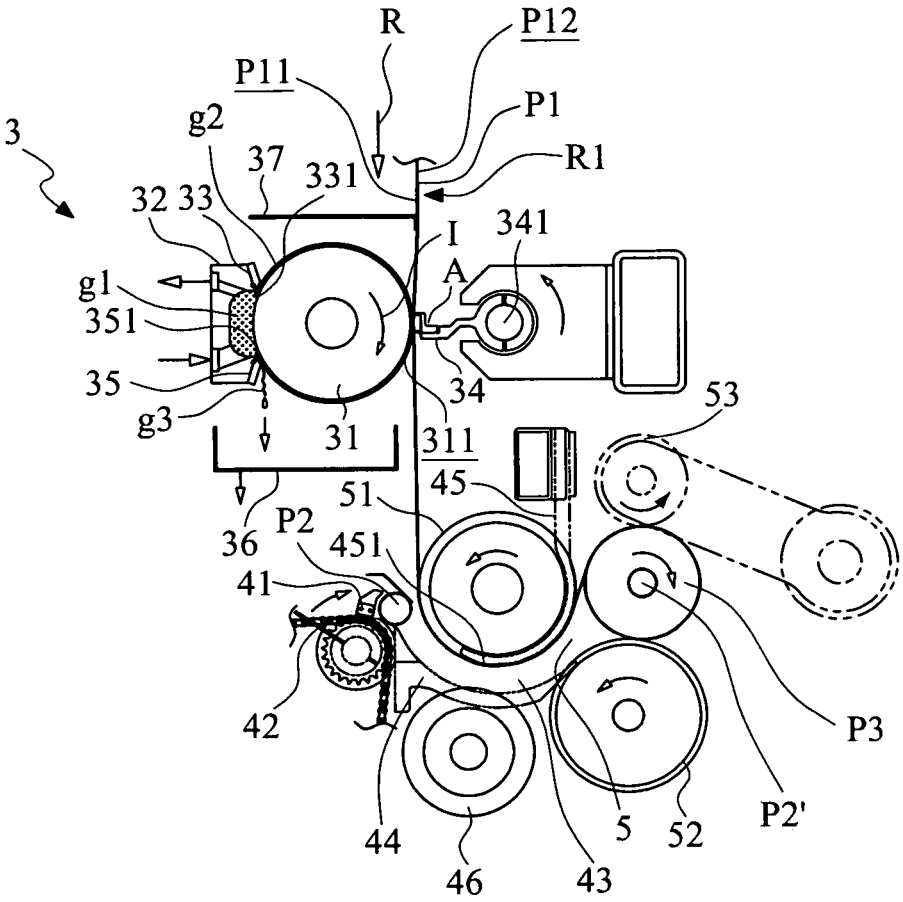
FIG. 13 is a schematic side view showing the pushing member at a pushing position.
Figure 14:
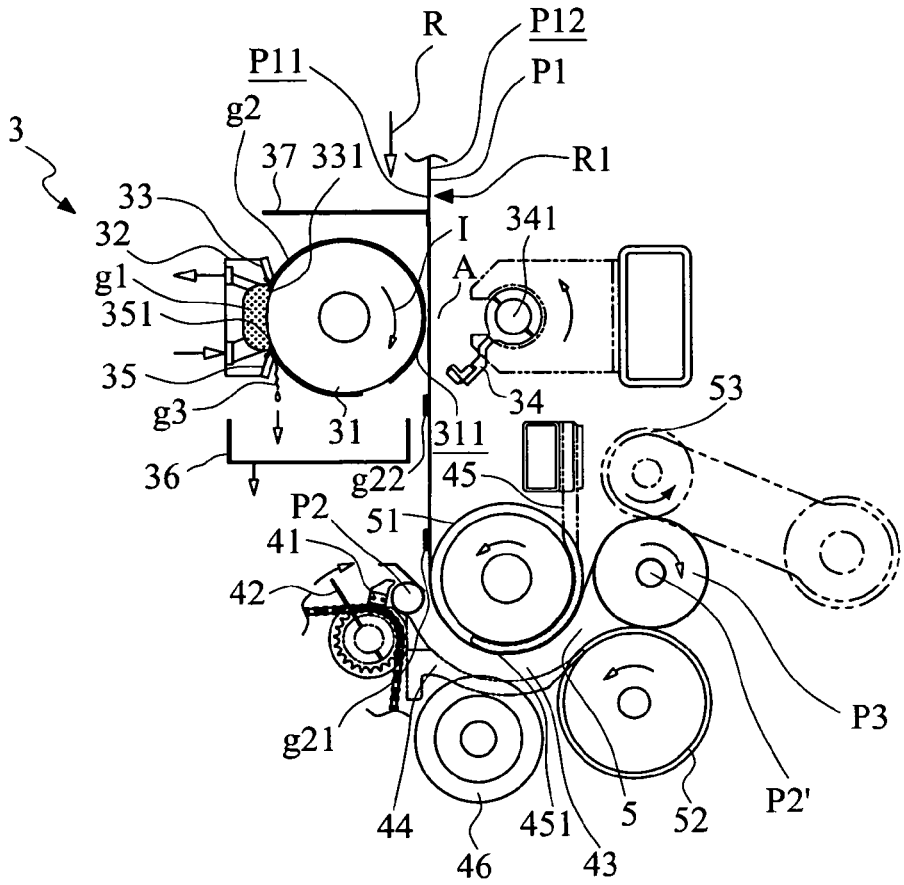
FIG. 14 is a schematic side view showing the condition when the pushing member completes a gluing operation.

Referring to FIGS. 12-14, FIGS. 12-14 respectively illustrate a top view of the pushing member, a schematic side view showing the pushing member at a pushing position, and a schematic side view showing the condition when the pushing member completes a gluing operation. The pushing member 34 is provided at a location close to the web material traveling path R1 and faces a contact side P12 of the web material P1 that is opposite to the gluing side P11. The pushing member 34 is coupled to a shaft 341 and is driven by a driving mechanism 342 to rotate with the shaft 341 as a rotation center. When the pushing member 34 is rotated to a pushing position A (see FIG. 13), the web material P1 is pushed by the pushing member 34 to touch the glue layer g2 that is formed on the glue carrying roller surface 311 of the glue dispensing roller 31, whereby the gluing side P11 of the web material P1 is locally coated with a tail glue g21 (referring to the FIG. 14 and referring to step 104 showed on the FIG. 2 also).

The web material P1 that is with the glue coated continues to advance. If necessary, the pushing member 34 may make a second turn to have the gluing side P11 of the web material P1 locally coated with an initial glue g22 at a location distant from the tail glue g21. The distance can be changed by adjusting the rotational speed of the pushing member 34. Although the first embodiment of the present invention demonstrates application of the tail glue g21 and the initial glue g22 to the web material P1, it is practically possible to apply only the tail glue g21 or the initial glue g22 to the web material P1 according to practical needs. Practically, a predetermined area of a core P2 can be applied with the initial glue thereon (not shown) while the core P2 is conveyed by a core carrier 41 of a conveyor.

Figure 15:
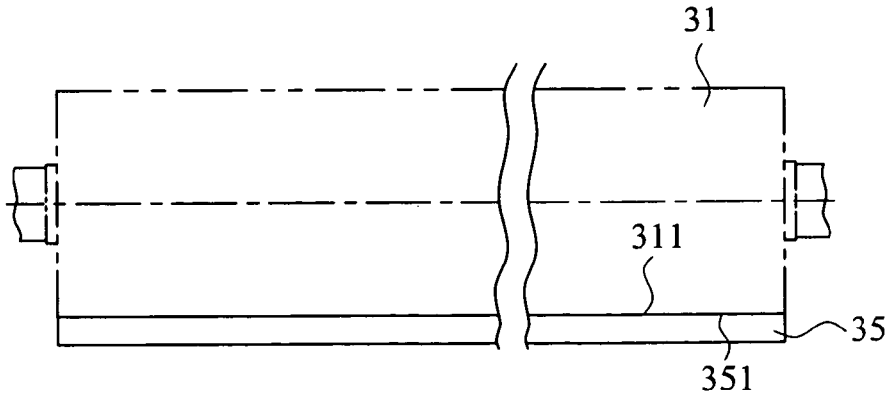
FIG. 15 is a schematic bottom view showing an assembly of a flat scraper blade and a glue dispensing roller.

Referring to FIG. 15, FIG. 15 is a schematic bottom view showing an assembly of the flat scraper blade and the glue dispensing roller. The flat scraper blade 35 is parallel with the axial of the glue dispensing roller 31 and faces the glue carrying roller surface 311 of the glue dispensing roller 31. The flat scraper blade 35 has a scraper edge 351 touching the glue carrying roller surface 311 of the glue dispensing roller 31. The scraper edge 351 of the flat scraper blade 35 is flat, and without notches, serving to scrap excessive or residual glue g3 (see FIG. 1) off from the glue carrying roller surface 311 after the web material P1 is applied with the glue. The excessive glue g3, after being scraped off, drops down to the glue collection tank 36 that is provided below the glue dispensing roller 31 by a given distance for collection and reuse (referring to the step 105 showed on the FIG. 2).

The fender 37 is provided above the glue dispensing roller 31 by a given distance and used to lightly touch the gluing side P11 of the web material P1 so as to maintain a small gap between the web material P1 and the glue layer g2 formed on the glue carrying roller surface 311 of the glue dispensing roller 31. After the web material P1 is pushed by the pushing member 34 to touch and is thus applied with the glue by the glue layer g2, the web material P1 that is separated from the glue layer g2 according to the web material P1 is subjected to a returning force applied from the fender 37, and accordingly, a small gap is maintained between both again.

On the other hand, the core P2 is conveyed by a core carrier 41 of the conveyor and is further forced into a passage 43 by a push plate 42. The passage 43 is delimited between a core support plate 44 and a first winding roller 51. When the core P2 enters the passage 43 and is adhered to the web material P1, the core P2 is moved to a winding nip 5.

Figure 16:
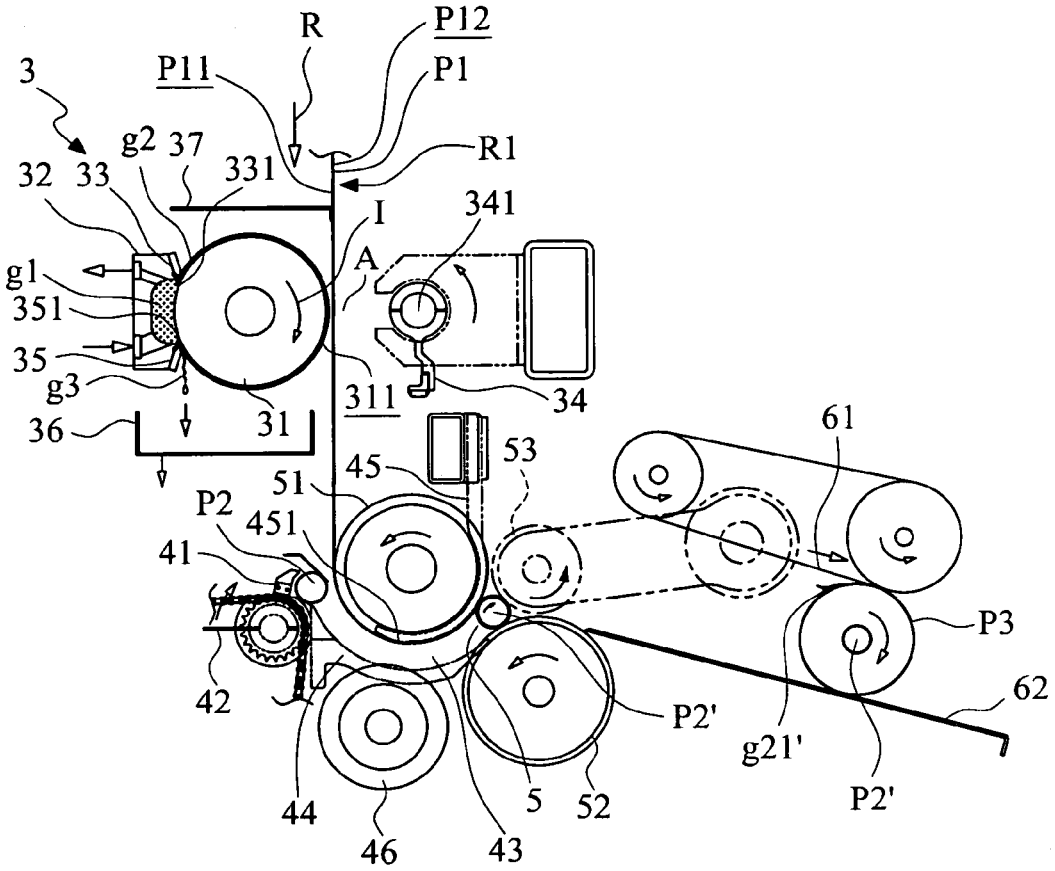
FIG. 16 is a schematic side view showing a core entering a winding nip and a web material wound thereon.
Figure 17:
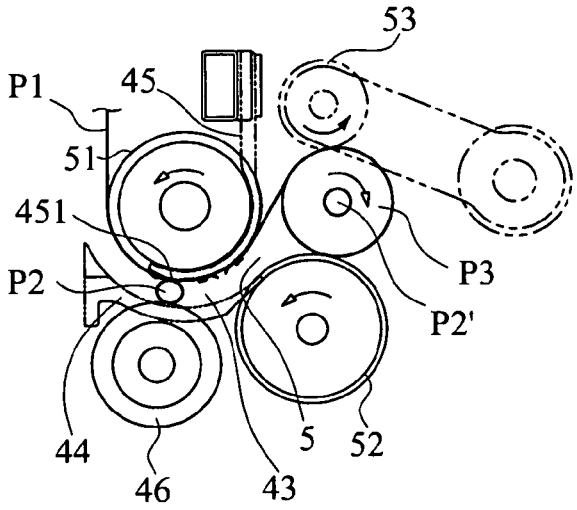
FIG. 17 is schematic side view showing the core and the web material are continuously rolled in the winding nip and the web material is torn off.

Referring to FIG. 16, a schematic side view showing the core entering the winding nip and the web material wound thereon is illustrated. The winding nip 5 is defined among the first winding roller 51, a second winding roller 52, and a rider roller 53. In the winding nip 5, the core P2' is adhered to the web material P1, and the web material P1 are continuously wound around the core P2' and forms a web material roll P3 (also see FIG. 17).

When the winding operation of the web material roll P3 is almost finished, a next core P2 is conveyed to a pinch roller 46 in the passage 43, wherein the web material P1 is pinched between said next core P2 and protuberances 451 of severing arms 45 and is thus torn off. After finishing the web material roll P3 winding operation, the web material roll P3 is discharged along an inclined chute 62 and a belt 61.

Figure 18:
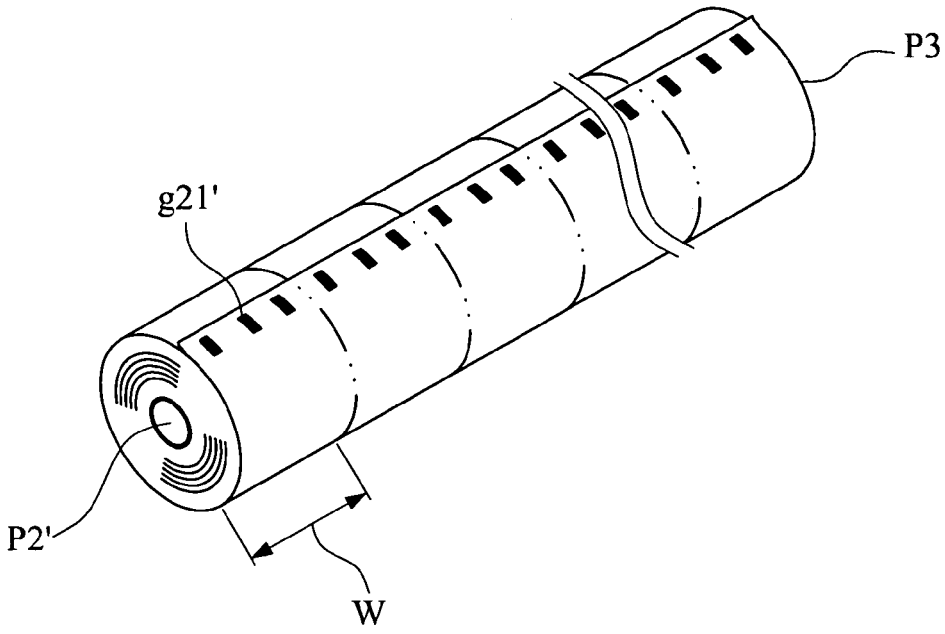
FIG. 18 is a perspective view of a completed web material roll.
Figure 19:
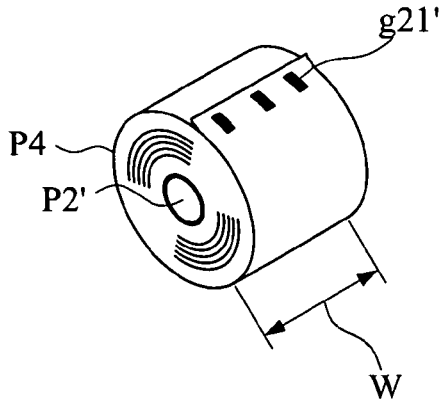
FIG. 19 is a perspective view of a cut segment of the roll.
Figure 20:
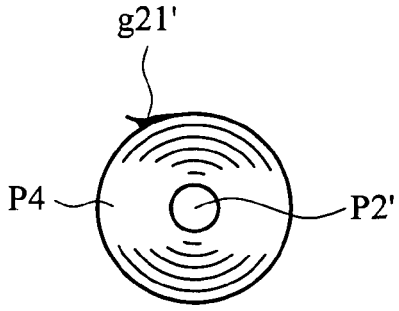
FIG. 20 is a side view of the cut segment of the roll.

Referring to FIGS. 18-20, a perspective view of the completed web material roll, a perspective view of a cut segment of the roll, and a side view of the cut roll segment are illustrated. As shown, the web material roll P3, which can be as a toilet paper roll, a tissue paper roll, or a kitchen towel roll alternatively, has a tail end that is sealed or fixed by means of the tail glue g21' during the gluing operation. When the web material roll P3 is provided to user, the web material roll P3 is cut into a plurality of short roll segments P4 having a width W.

Figure 21:
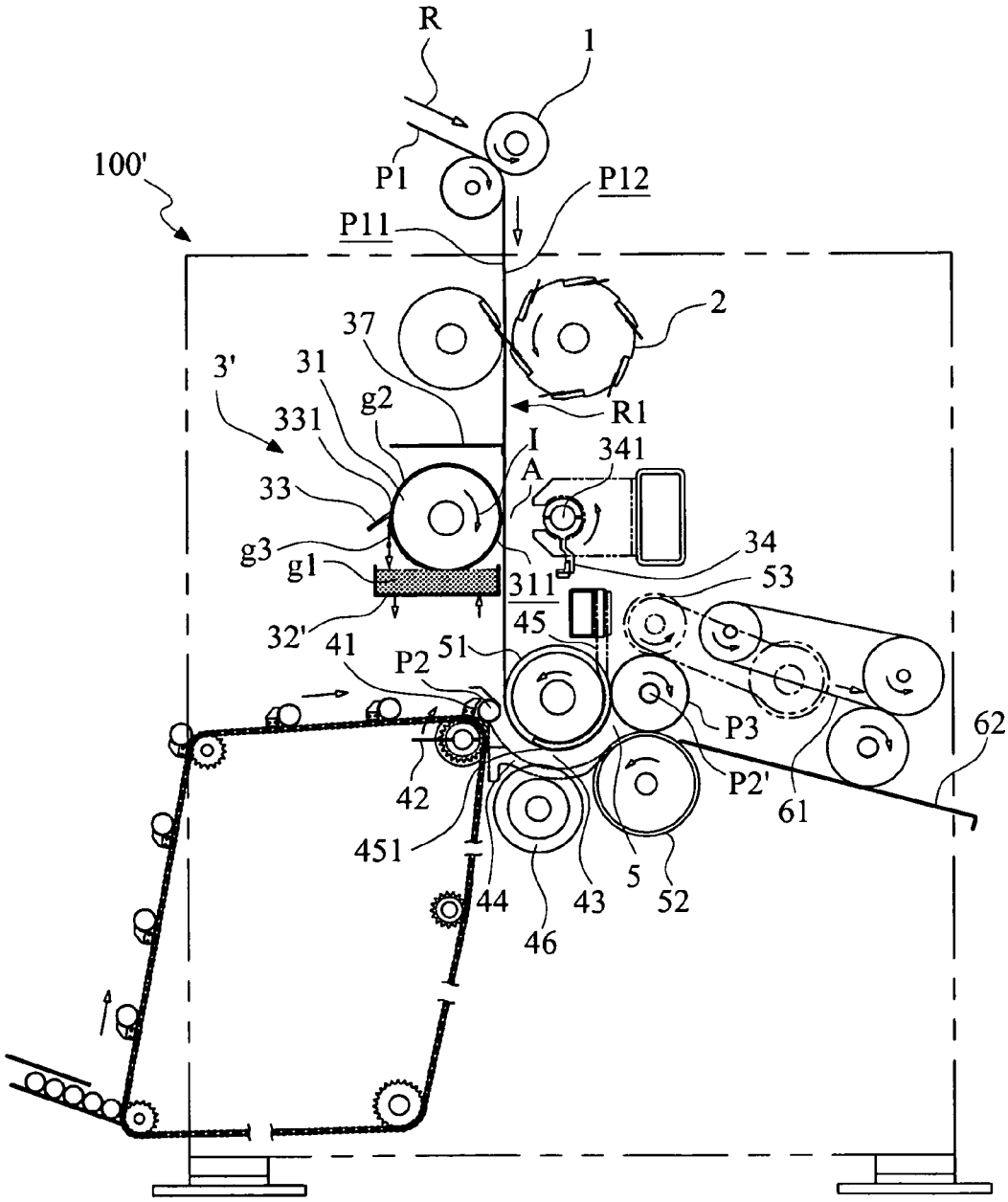
FIG. 21 is a schematic side view of a second embodiment of the present invention.
Figure 22:
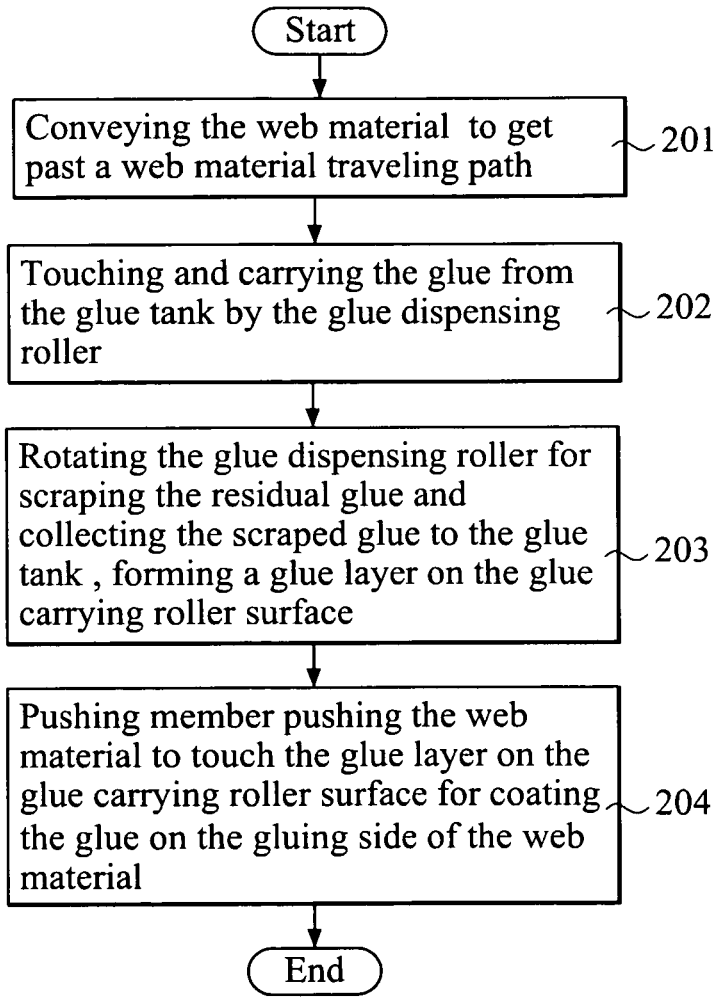
FIG. 22 is a flow chart of the second embodiment of the present invention.

FIGS. 21 and 22 respectively illustrate a schematic side view and a flow chart in accordance with a second embodiment of the present invention. The web material winding device of the second embodiment, which is designated with reference numeral 100', has a construction substantially identical to that of the previously discussed first embodiment, so that similar parts/components are labeled with similar reference numerals for simplicity and correspondence therebetween.

A gluing mechanism 3' of the second embodiment is comprised of only a glue dispensing roller 31, a glue tank 32', a notched scraper blade 33, at least one pushing member 34, and a fender 37. The glue tank 32' is provided below the glue dispensing roller 31 by a given distance. A notched scraper blade 33 can be fixed by any known means and is positioned at a side of the glue dispensing roller 31. The notched scraper blade 33 has a scraper edge 331 that is with at least one notch 332 (also see FIG. 7). Similar to the previously discussed first embodiment, a web material P1 is conveyed to get past a web material traveling path R1 (step 201) and the glue dispensing roller 31 is set in rotation to have a glue carrying roller surface 311 of the glue dispensing roller 31 touching and carrying the glue g1 from the glue tank 32' (step 202). Excessive or residual glue g3 is scraped off when passing through the scraper edge 331 of the notched scraper blade 33, and the portions of the glue g1 that correspond in position to the notches 332 of the notched-scraper blade 33 are left on the glue carrying roller surface 311 of the glue dispensing roller 31 to form a glue layer g2 (step 203). By means of pushing by the pushing member 34, the glue is applied to a gluing side P11 of the web material P1 (step 204).

Compared to the first embodiment, the second embodiment eliminates the glue collection tank 36 of the first embodiment. The excessive glue g3, after being scraped off by the scraper edge 331 of the notched scraper blade 33, drops down into the glue tank 32' that is provided below the glue dispensing roller 31, rather than the glue collection tank 36 of the first embodiment. In this way, the collected glue g1 in the glue tank 32' can be used after collecting for recycle, and accordingly, the glue collection tank 36 is no longer needed.

Although the present invention has been described with reference to the best mode for carrying out the present invention, as well the preferred embodiments of the present invention, it is apparent to those skilled in the art that a variety of modifications and changes may be made without departing from the scope of the present invention which is intended to be defined by the appended claims.

What is claimed is:

1. A gluing mechanism adapted to apply glue to a gluing side of a web material traveling along a web material traveling path, the gluing mechanism comprising:

a glue dispensing roller disposed adjacent to the web material traveling path and faces the gluing side of the web material, wherein the glue dispensing roller is driven to rotate according to a predetermined rotation direction, and the glue dispensing roller defines a glue carrying roller surface;

a glue tank provided beside the glue dispensing roller and containing an amount of glue;

a notched scraper blade facing the glue carrying roller surface of the glue dispensing roller, wherein the notched scraper blade comprises a scraper edge for touching the glue carrying roller surface of the glue dispensing roller, and the scraper edge of the notched scraper blade comprises at least one notch;

a glue collection tank provided below the glue dispensing roller by a given distance;

at least one pushing member facing a contact side of the web material, wherein when the pushing member is driven to rotate to a pushing position, the web material is pushed by the pushing member to touch a glue layer on the glue carrying roller surface of the glue dispensing roller and the gluing side of the web material is coated with the glue; and a fender provided above the glue dispensing roller and used to lightly touch the gluing side of the web material;

wherein when the glue dispensing roller rotates, the glue carrying roller surface of the glue dispensing roller contacts and carries the glue from the glue tank;

wherein when the glue is carried by the glue carrying roller surface of the glue dispensing roller, and passes through the at least one notch of the scraper edge of the notched scraper blade, the scraper edge of the notched scraper blade scrapes the glue from a portion of the glue carrying roller surface corresponding with a non-notched section of the scraper edge;

wherein the glue layer is formed on the glue carrying roller surface of the glue dispensing roller by the glue passing through the at least one notch of the notched scraper blade;

wherein a gap is provided between the web material and the glue layer; and wherein after the web material is pushed by the pushing member to be coated with the glue, the web material is separated from the glue layer on the glue carrying roller surface of the glue dispensing roller.

2. The gluing mechanism as claimed in claim 1 further comprising a flat scraper blade facing the glue carrying roller surface of the glue dispensing roller for scraping off the excessive glue from the glue carrying roller surface, wherein the excessive glue flows into the glue collection tank for recycle.

3. A gluing mechanism adapted to apply glue to a gluing side of a web material traveling along a web material traveling path, the gluing mechanism comprising:

a glue dispensing roller disposed adjacent to the web material traveling path and faces the gluing side of the web material, wherein the glue dispensing roller is driven to rotate according to a predetermined rotation direction, and the glue dispensing roller defines a glue carrying roller surface;

a glue tank provided below the glue dispensing roller and containing an amount of glue;

a notched scraper blade facing the glue carrying roller surface of the glue dispensing roller, wherein the notched scraper blade comprises a scraper edge for touching the glue carrying roller surface of the glue dispensing roller, and the scraper edge of the notched scraper blade comprises at least one notch;

at least one pushing member facing a contact side of the web material, wherein when the pushing member is driven to rotate to a pushing position, the web material is pushed by the pushing member to touch a glue layer on the glue carrying roller surface of the glue dispensing roller and the gluing side of the web material is coated with the glue; and a fender provided above the glue dispensing roller and used to lightly touch the gluing side of the web material;

wherein when the glue dispensing roller is rotated, the glue carrying roller surface of the glue dispensing roller contacts and carries the glue from the glue tank;

wherein when the glue is carried by the glue carrying roller surface of the glue dispensing roller and passes through the scraper edge of the notched scraper blade, the scraper edge of the notched scraper blade scrapes off the excessive glue;

wherein the excessive glue flows back to the glue tank;

wherein the glue layer is formed on the glue carrying roller surface of the glue dispensing roller by the glue passing through the at least one notch of the notched scraper blade;

wherein a gap is provided between the web material and the glue layer; and wherein after the web material is pushed by the pushing member to be coated with the glue, the web material is separated from the glue layer on the glue carrying roller surface of the glue dispensing roller.

* * * * *